United States Patent [19]

Jencks et al.

[11] Patent Number: 4,550,300

[45] Date of Patent: Oct. 29, 1985

[54] LATCH RELEASE MECHANISM FOR MOLDED CASE ELECTRIC CIRCUIT BREAKERS

[75] Inventors: Charles L. Jencks, Avon; Roger N. Castonguay, Terryville, both of Conn.

[73] Assignee: General Electric Company, New York, N.Y.

[21] Appl. No.: 609,042

[22] Filed: May 10, 1984

[51] Int. Cl.[4] ..... H01H 75/00; H01H 73/48

[52] U.S. Cl. ..... 335/16; 335/22; 335/169

[58] Field of Search ..... 335/16, 195, 22, 166, 335/168, 169, 175

[56] References Cited

U.S. PATENT DOCUMENTS 4,255,732 3/1981 Wafer et al. ..... 335/16

*Primary Examiner*—Harold Broome

*Attorney, Agent, or Firm*—Richard A. Menelly; Walter C. Bernkopf; Fred Jacob

[57] ABSTRACT

High speed trip facility is provided within a molded case circuit breaker used within industrial applications. The movable contact arm is pivotally arranged to open independently of the trip unit-driven operating mechanism. A "latch kicker" arrangement interfaces between the mechanism trip bar and the circuit breaker intermediate latch whereby rotation of the trip bar causes the latch kicker to immediately displace the intermediate latch from the circuit breaker cradle thereby allowing the interrupter mechanism to untoggle the mechanism and open the breaker contacts.

4 Claims, 3 Drawing Figures

LATCH RELEASE MECHANISM FOR MOLDED CASE ELECTRIC CIRCUIT BREAKERS

BACKGROUND OF THE INVENTION

Molded case industrial-type circuit breakers having a wide range of ampere and voltage ratings are available within a standard size breaker case geometry. This is made possible by relatively minor variations in the breaker components in order to keep the overall breaker geometry constant. The concept of "current limiting", wherein the movable contact arm is pivoted independently of the breaker operating mechanism, allows for circuit interruption early within the current waveform. Less current is then available when the operating mechanism responds to the overload. The steady state current carrying components, such as the contacts, contact arm and flexible braid conductor, must be enlarged when the breaker rating is increased in order not to become heated under steady state current conditions at the higher rating. One efficient method for allowing the movable contact arm to respond independently of the trip unit early in the current waveform is by the means of a U-shaped contact braid conductor. The opposing magnetic fields generated within the parallel legs of the U-shaped connection provides sufficient repulsive forces to propel the movable contact arm into its open position. Since most industrial circuit breakers are used in a three-phase arrangement with each phase having its own movable contact arm, it is expedient for the operating mechanism to open all three phases as quickly as possible.

In most molded case industrial-type circuit breakers, an intermediate latch is often employed along with the main latch to ensure that the breaker does not trip upon spurious conditions of overload. However, when the breaker is called upon to trip under short circuit conditions, some time is involved for the intermediate latch to release the cradle surface before the operating mechanism can become untoggled to open the breaker contacts. An efficient arrangement for rapidly releasing the intermediate latch from the cradle is described within U.S. patent application Ser. No. 500,643 filed June 2, 1983 and entitled "Circuit Breaker Assembly For High Speed Manufacture". This application is incorporated herein for purposes of reference.

The purpose of this invention is to provide an arrangement for rapidly displacing the intermediate latch from the cradle by interacting the trip bar with the intermediate latch.

SUMMARY OF THE INVENTION

The invention comprises a latch releasing mechanism which reacts between the contact trip bar and the intermediate latch on a circuit breaker for effectively causing the trip bar to move the intermediate latch out of contact with the cradle. In one embodiment, the latch operating mechanism comprises a latch kicker pivotally mounted intermediate a top and bottom end. The top end receives the trip bar and forces the bottom end to move the intermediate latch out of contact with the cradle.

DESCRIPTION OF THE PREFERRED EMBODIMENT

Figure 1:
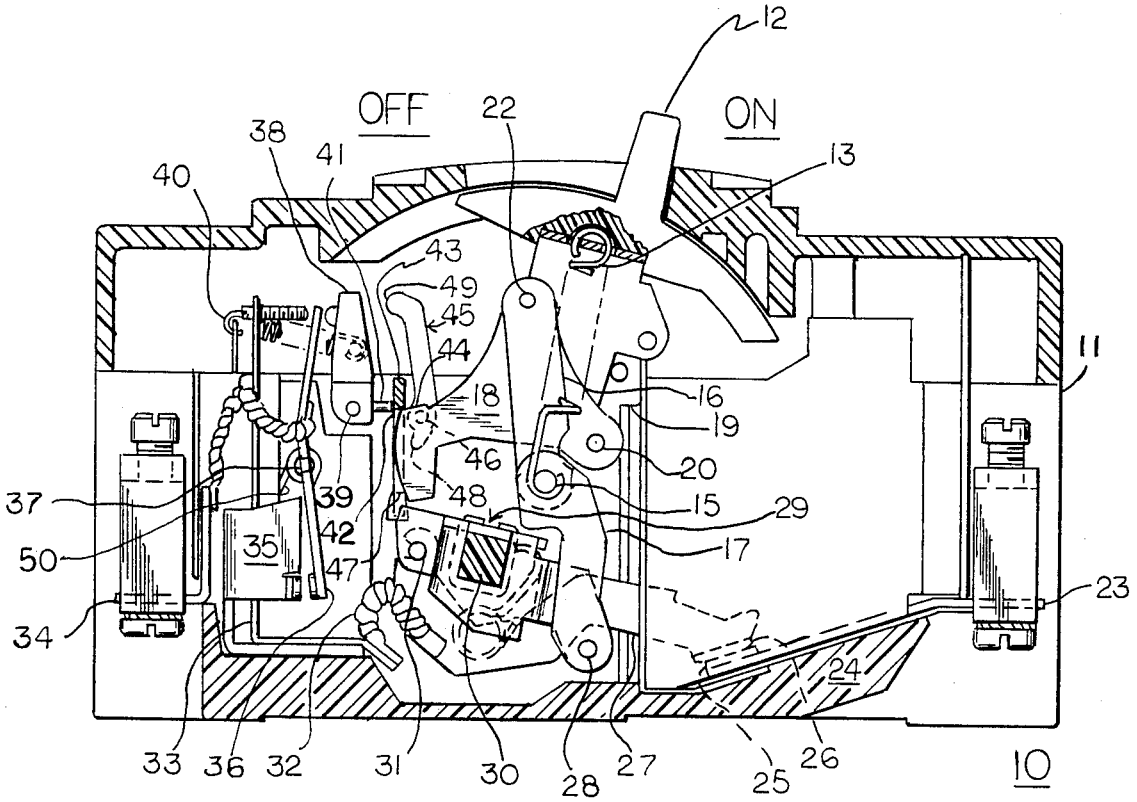
FIG. 1 is a side view of a molded case industrial-type electric circuit breaker with a portion of the case removed to show the internal breaker components.

FIG. 1 contains a molded case industrial-type circuit breaker 10 similar to that described within U.S. Pat. No. 3,605,052 to Herbert M. Dimond et al, which patent is incorporated herein for purposes of reference. The breaker is the type containing a molded case 11 of insulated material and having an operatively mounted ON/-OFF handle 12 which connects with an overtoggle pivot pin 15 by means of an operating mechanism spring 13. An upper link 16 and a lower link 17 are pivotally connected by means of the overtoggle pivot pin 15 which connects by means of a pin 22 through the upper link 16 with an operating cradle 18. The cradle is pivotally connected to a side support 19 by means of a pivot pin 20 and maintains the upper and lower links 16, 17 in the toggled or "ON" position shown in FIG. 1. A line strap 23 arranged on a bottom insulating support 24 connects with a fixed contact 25. A movable contact 26 at one end of a movable contact arm 27 is held in electrical connection with the fixed contact when the handle is in the ON position. The movable contact arm 27 is supported by means of a contact carrier 29 which is pivotally supported by means of the circuit breaker crossbar 30 in the manner described within the Dimond et al patent as well as by the lower link 17 by means of support pin 28. A separate pivot 31 is provided to allow the movable contact arm 27 to pivot independently of the contact carrier 29 when a short circuit condition occurs through the breaker and electrical current transports through the U-shaped braid conductor 32. The circuit is completed through a conductor 33 to the load terminal strap 34 as indicated. A magnet 35 in combination with an armature 36 pivotally mounted by means of a pivot pin 37 about an armature spring 50 provides the magnetic tripping that occurs under such short circuit overload conditions. The trip bar 38 is biased by spring 40 such that the trip bar latch 41 rests against a latch surface 42 on intermediate latch 43 and is pivotally connected by means of pivot 39 to the side support frame 19. When called upon to trip, the trip bar 38 rotates in a clockwise direction causing the trip bar latch 41 to slide away from latch surface 42. An intermediate latch 43, which is pivotally attached to the side support frame 19 by means of pivot 47, rests against the intermediate latch surface 44 on cradle 18 must move off the latch surface 44 before the cradle can be released allowing the circuit breaker to trip. It was determined that a substantial amount of the total tripping time, that is, from the time that the trip unit rotates the trip bar 38 to the time that the cradle 18 allows the upper and lower links 16, 17 to untoggle and open contacts 25, 26, is involved in the intermediate latch sliding off surface 44. When the circuit breaker is employed within a three-phase circuit, it is important that the other two phases be interrupted by the rotation of the crossbar 30 under short circuit overload conditions when one pair of contacts, such as 25, 26, becomes separated by means of the magnetic repulsion exerted by the conducting braid 32 on the movable contact arm 27 in order to prevent "single-phasing". Some means must be provided to ensure that the breaker tripping mechanism respond as rapidly as possible to rotate the crossbar 30 once the movable contact arm 27 has responded to overload. An efficient apparatus for rapidly providing an increased tripping response is the intermediate latch "kicker" 45 which is pivotally connected to side support frame 19 by means of pivot 46. The latch kicker 45 has a trip bar contact surface 49 at one end and an intermediate latch contact surface 48 at an opposite end and operates in the following manner. When the armature 36 rotates the trip bar 38 in a clockwise direction, the trip bar latch 41 slides along surface 42 and releases the intermediate latch. The trip bar next contacts the trip bar contact surface 49 on the latch kicker immediately rotating the latch kicker about pivot 46 in a clockwise direction which in turn drives the kicker contact surface 48 against latch 43 moving the latch out of contact with the intermediate latch contact surface 44 on cradle 18. This is the condition indicated in FIG. 3 immediately before untoggling of the upper and lower links 16, 17.

Figure 2:
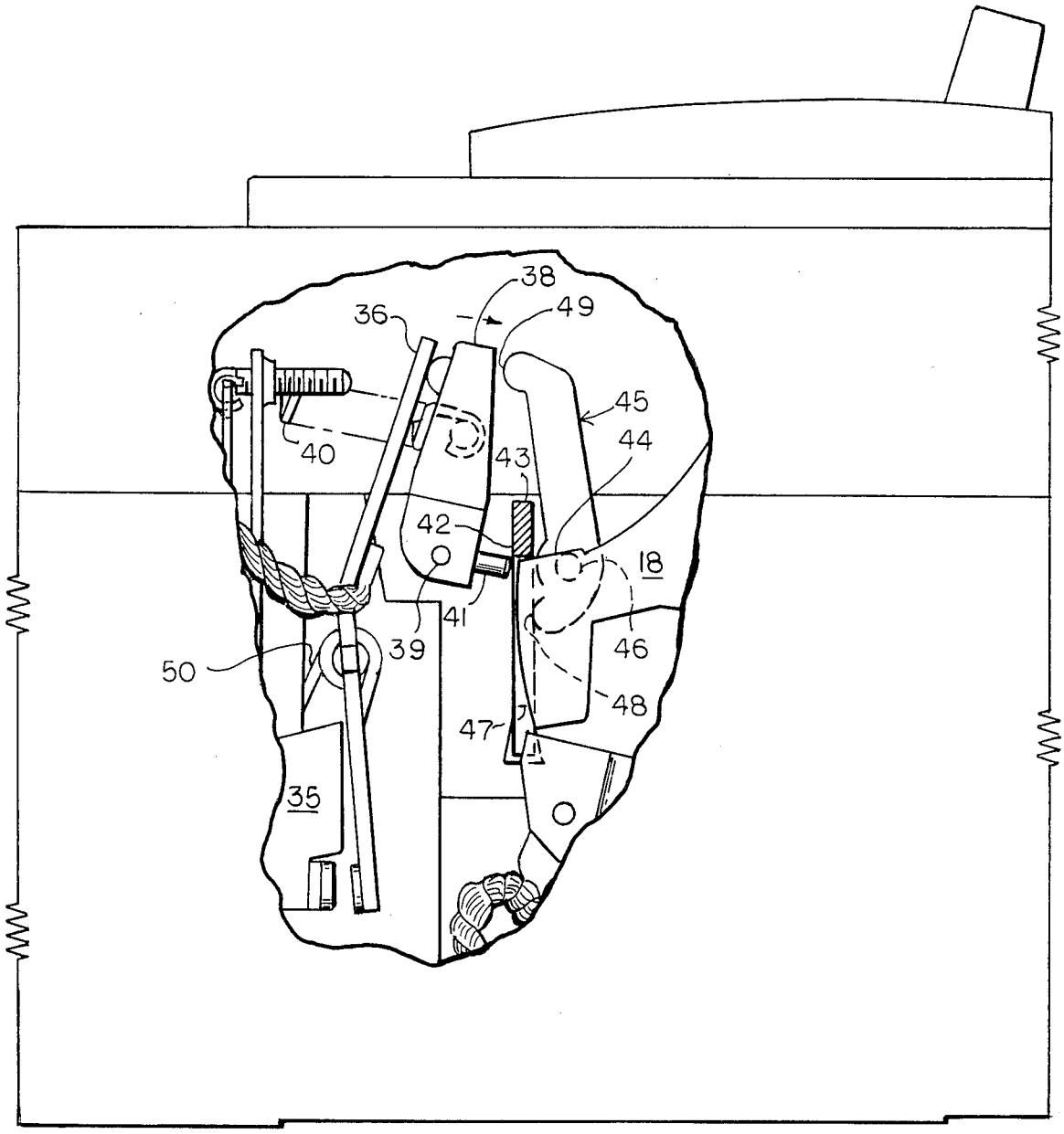
FIG. 2 is a side view of the intermediate latch and latch kicker arrangement.

FIG. 2 shows the operation of the latch kicker 45 when the armature 36 first contacts and rotates the trip bar 38 to the position where latch 41 has just cleared latch surface 42 and the intermediate latch surface 44 on cradle 18 is still in contact with the intermediate latch 43. The trip bar contact surface 49 on the latch kicker 45 has not as yet been contacted by the trip bar 38. The latch contact surface 48 on the latch kicker 45 is in contact with the intermediate latch 43 but has not displaced the intermediate latch 43 from contact with the intermediate latch surface 44 on cradle 18.

Figure 3:
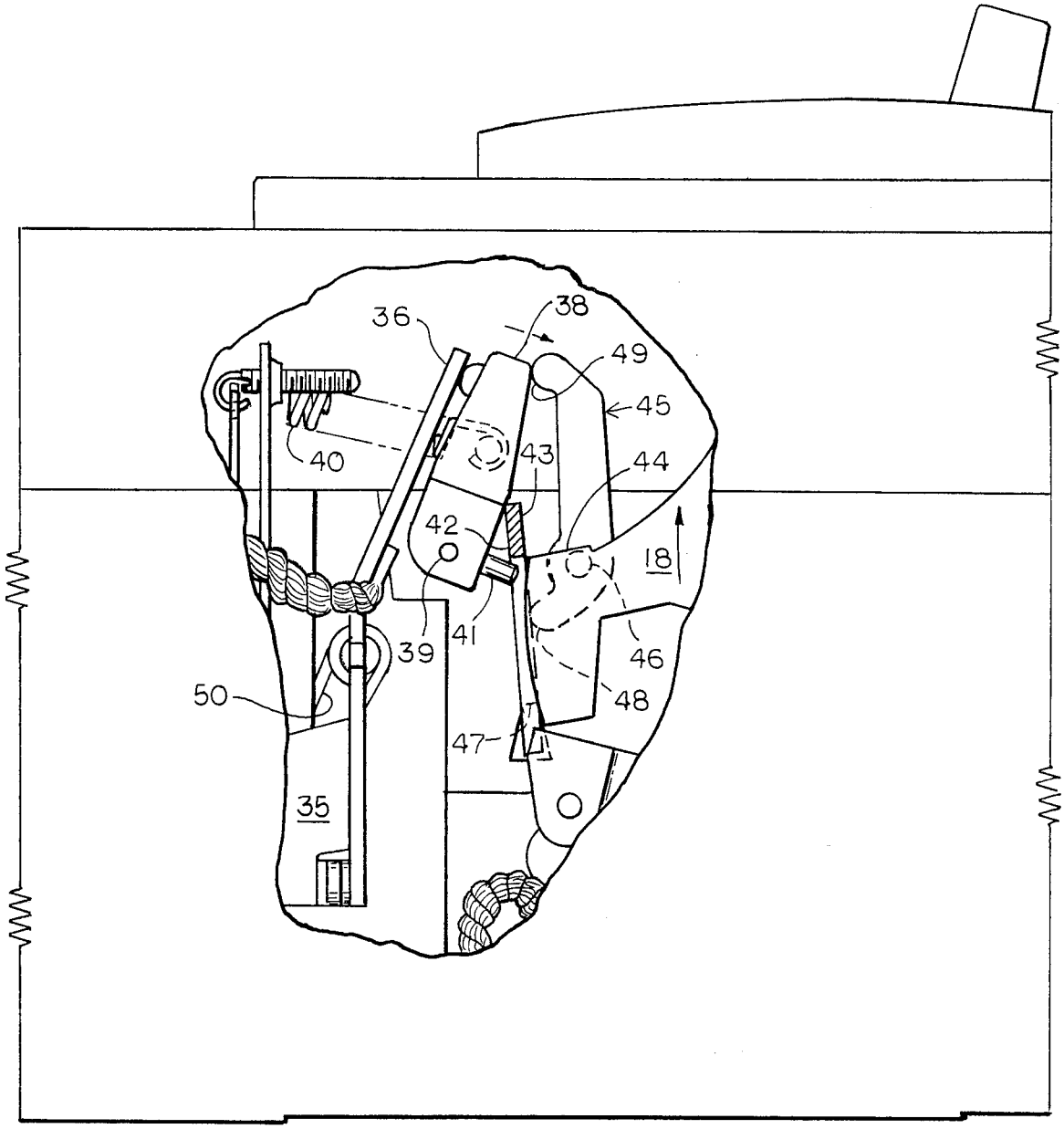
FIG. 3 is a side view of the circuit breaker depicted in FIG. 1 with the latch kicker in contact with the trip bar and the intermediate latch.

FIG. 3 shows the latch kicker 45 immediately after contact by the armature 36 wherein continued motion of the armature 36 has rotated the trip bar 38 far enough to contact the trip bar contact surface 49 on latch kicker 45 rotating it clockwise and forcing the latch contact surface 48 to drive the intermediate latch 43 off the latch surface 44 of the cradle 18. The operating mechanism spring 13 shown in FIG. 1 can now freely rotate the cradle 18 clockwise, untoggling the upper and lower links 16, 17 and rotating the contact carrier 29 and crossbar 30 counterclockwise thereby opening the contacts 25, 26 of all three phases. As soon as the contacts open and power ceases to flow, the armature 36 returns to the position shown in FIG. 1, due to the counterclockwise bias of the armature spring 50, and the trip bar 38 returns to an intermediate position due to the bias of spring 40.

It is thus seen that the latch kicker 45 provides a valuable function when used with circuit breakers of the type that contain a current limiting contact arm having an independent pivot and some means for magnetically operating the movable contact arm under short circuit conditions of overload. The contact kicker provides the necessary increase in the tripping speed to ensure that the breaker operating mechanism will respond as soon as the movable contact arm is magnetically driven into its open position.

Having described our invention, what we claim as new and desire to secure by Letters Patent is:

1. A molded case electric circuit breaker comprising:

an operating mechanism for separating a pair of fixed and movable contacts;

a movable contact arm supporting said movable contact at one end and pivotally arranged for operation independent of said operating mechanism;

a cradle operatively connecting between said operating mechanism and an intermediate latch for preventing said operating mechanism from separating said pair of fixed and movable contacts;

a trip unit for sensing current flow through said pair of fixed and movable contacts and moving said intermediate latch out of contact with said cradle to allow said operating mechanism to separate said fixed and movable contacts when said current exceeds a predetermined value;

a trip bar latch contacting said intermediate latch for preventing said intermediate latch from disengaging said cradle until said current exceeds said predetermined value; and a latch releasing mechanism proximate said trip bar and said intermediate latch for contact with said trip bar at one end and with said intermediate latch at an opposite end to move said intermediate latch out of contact with said cradle for increasing the rate at which said operating mechanism separates said pair of fixed and movable contacts when said predetermined current value is exceeded.

2. The molded case electric circuit breaker of claim 1 wherein said trip unit includes a trip bar rotatably mounted within said breaker, said trip bar latch being attached to said trip bar and biased against said intermediate latch by means of a trip bar spring.

3. The molded case electric circuit breaker of claim 1 wherein said intermediate latch is pivotally attached to a side frame for engaging a latching surface on said cradle.

4. The molded case electric circuit breaker of claim 3 wherein said latch releasing mechanism comprises a flat bar pivotally attached to said side frame intermediate said ends whereby contact with said trip bar at said one end causes said opposite end to move said intermediate latch out of contact with said cradle.

* * * * *